US010433586B2

(12) United States Patent
Bernauer et al.

(10) Patent No.: US 10,433,586 B2
(45) Date of Patent: Oct. 8, 2019

(54) SWITCH FAILURE MONITORING IN AN ELECTRICALLY HEATED SMOKING SYSTEM

(71) Applicant: Philip Morris Products S.A., Neuchatel (CH)

(72) Inventors: Dominique Bernauer, Neuchatel (CH); Felix Fernando, Basingstoke (GB)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/517,172

(22) PCT Filed: Oct. 8, 2015

(86) PCT No.: PCT/EP2015/073288
§ 371 (c)(1),
(2) Date: Apr. 6, 2017

(87) PCT Pub. No.: WO2016/058904
PCT Pub. Date: Apr. 21, 2016

(65) Prior Publication Data

US 2017/0303595 A1 Oct. 26, 2017

(30) Foreign Application Priority Data

Oct. 13, 2014 (EP) ..... 14188685

(51) Int. Cl.
*A24F 13/00* (2006.01)
*A24F 17/00* (2006.01)
(Continued)

(52) U.S. Cl.
CPC ..... *A24F 47/008* (2013.01); *H05B 1/0291* (2013.01)

(58) Field of Classification Search
CPC ..... A24F 47/008; A24F 47/002; H05B 3/06; H05B 3/03
(Continued)

(56) References Cited

U.S. PATENT DOCUMENTS 4,277,670 A 7/1981 Mori et al.
4,947,875 A 8/1990 Brooks et al.
(Continued)

FOREIGN PATENT DOCUMENTS

AU A-17280/92 12/1992
CN 201 683 029 U 12/2010
(Continued)

OTHER PUBLICATIONS

International Preliminary Report on Patentability and Written Opinion dated Apr. 27, 2017 in PCT/EP2015/073288.
(Continued)

*Primary Examiner* — Abdullah A Riyami
*Assistant Examiner* — Thang H Nguyen
(74) *Attorney, Agent, or Firm* — Oblon, McClelland, Maier & Neustadt, L.L.P.

(57) ABSTRACT

A method of controlling an electric heater in an electrically heated smoking system is provided, including providing electrical power to the heater in pulses such that during active periods power is supplied to the heater and during inactive periods power is not supplied to the heater; charging a capacitor in an RC circuit during the inactive periods and allowing the capacitor to discharge during the active periods; and monitoring a discharge voltage of the capacitor and if the discharge voltage of the capacitor drops below a threshold voltage level, then stopping further supply of electrical power to the heater.

13 Claims, 2 Drawing Sheets

(51) Int. Cl.

| | |
|---|---|
| ***A24F 25/00*** | (2006.01) |
| ***A24F 11/00*** | (2006.01) |
| ***A24F 47/00*** | (2006.01) |
| ***H05B 1/02*** | (2006.01) |

(58) Field of Classification Search
USPC ..... 131/329, 328
See application file for complete search history.

(56) References Cited

U.S. PATENT DOCUMENTS

| | | | | | |
|---|---|---|---|---|---|
| 5,060,671 | A * | 10/1991 | Counts | A24F 47/008 | 128/202.21 |
| 5,144,962 | A * | 9/1992 | Counts | A24F 47/008 | 128/200.14 |
| 5,261,424 | A * | 11/1993 | Sprinkel, Jr. | A24F 47/008 | 128/202.21 |
| 5,694,770 | A * | 12/1997 | Bruck | F01N 3/2013 | 422/174 |
| 2001/0008236 | A1* | 7/2001 | Allard | H05B 1/0272 | 219/481 |
| 2003/0226837 | A1* | 12/2003 | Blake | A24F 47/008 | 219/260 |
| 2009/0230017 | A1 | 9/2009 | Fernando et al. | | |
| 2011/0265806 | A1* | 11/2011 | Alarcon | A24F 47/00 | 131/273 |
| 2013/0214806 | A1 | 8/2013 | Saloio, Jr. et al. | | |
| 2014/0299141 | A1 | 10/2014 | Flick | | |
| 2015/0237916 | A1 | 8/2015 | Farine et al. | | |
| 2015/0313284 | A1* | 11/2015 | Liu | H05B 1/0244 | 131/329 |
| 2016/0043626 | A1* | 2/2016 | Klyosov | H02M 1/08 | 363/132 |

FOREIGN PATENT DOCUMENTS

| | | | |
|---|---|---|---|
| CN | 101969800 | A | 2/2011 |
| CN | 102217427 | A | 10/2011 |
| CN | 103404969 | A | 11/2013 |
| CN | 103501847 | A | 1/2014 |
| CN | 103889258 | A | 6/2014 |
| DE | 11 2014 001 506 | T5 | 3/2016 |
| EP | 0 430 559 | A2 | 6/1991 |
| EP | 2 100 525 | A1 | 9/2009 |
| EP | 2 265 138 | B1 | 12/2012 |
| GB | 2527469 | A | 12/2015 |
| JP | 55-138665 | A | 10/1980 |
| JP | 58-176667 | A | 10/1983 |
| JP | 3053484 | U | 10/1998 |
| JP | 3392138 | | 1/2003 |
| JP | 2011-146302 | A | 7/2011 |
| JP | 2011-176963 | A | 9/2011 |
| WO | WO 2009/112182 | A1 | 9/2009 |
| WO | WO 2013/060781 | A1 | 5/2013 |
| WO | WO 2014/040988 | A2 | 3/2014 |
| WO | WO 2014/149017 | A1 | 9/2014 |

OTHER PUBLICATIONS

Taiwan Office Action with English translation dated Dec. 25 2018 in corresponding Taiwanese Patent Application No. 104132394, citing documents AA, AB, and AO therein (13 pages).

International Search Report and Written Opinion dated Dec. 22, 2015 in PCT/EP2015/073288, filed Oct. 8, 2015.

Chinese Office Action with English translation dated Mar. 29, 2019 in corresponding Chinese Patent Application No. 201580052663.0, citing documents AO-AT therein (10 pages).

http://labbookpages.co.uk/electronics/debounce.html, Switch Debouncing—The Lab Book Pages, Dr. Andrew Greensted. Last modified Jun. 17, 2019 (5 pages).

English translation of Taiwanese Office Action dated May 30, 2019 in corresponding Taiwanese Patent Application No. 104132394 citing document AO therein (5 pages).

Supercapacitor from Wikipedia (https://en.wikipedia.org/wiki/Supercapacitor), retrieved from https://web.archive.org/web/20140702165635/http://en.wikipedia.org/wiki/Supercapacitor, 117 captures from Dec. 15, 2005-Apr. 26, 2019 (53 pages).

Electronic Cigarette from Wikipedia (https://en.wikipedia.org/wiki/electronic_cigarette), retrived from https://web.archive.org/web/20141008195728/http://en.wikipedia.org/wiki/electronic_cigarette, 28 captures, Jul. 26, 2009-Aug. 1, 2017 (20 pages).

Schottky Diode from Wikepedia (https://en.wikipedia.org/wiki/Schottky_diode), retrieved from https://web.archive.org/web/2014092023910/http://en.wikipedia.org/wiki/Schottky_diode, 99 captures, May 17, 2004-Apr. 27, 2019 (7 pages).

* cited by examiner

SWITCH FAILURE MONITORING IN AN ELECTRICALLY HEATED SMOKING SYSTEM

TECHNICAL FIELD

The invention relates to a method and system for monitoring the operation of a switch in an electrical heating system. In particular, the invention relates to a method and system in which power is supplied to a heater in pulses by regularly operating a switch, in which operation of the switch is monitored and in which, in the event of a switch failure, the power supply to the heater is cut.

DESCRIPTION OF THE RELATED ART

One example of an electrical heating system is an electrically heated smoking system. In an electrically heated smoking system an electric heater is used to heat an aerosol-forming substrate, which may be a solid substrate, such as cast leaf tobacco, or a liquid substrate. Heating the substrate vapourises the desired flavour compounds, typically together with one or more aerosol-former compounds such as glycerine. In order to generate an aerosol that includes the desired flavour compounds and has the desired physical properties it is necessary that the substrate is heated to a sufficient temperature. However, it is also desirable that the system is controlled to prevent excessive temperatures being reached that might lead to the generation of undesirable compounds in the aerosol and even combustion of the substrate.

The temperature of the electric heater is typically regulated by regulating the supply of electrical power to the heater. Electrical power may be provided to the heater in the form of pulses of electrical current and by altering the duty cycle of the electric current (which is the ratio of the time during which current is supplied to the heater to the time current is not supplied to the heater) the temperature of the heating element can be altered or maintained.

One scenario in which excessive heater temperature may occur is when a current control switch, configured to turn the supply of current to the heater on and off, fails and gets stuck in the on configuration. It would be desirable to be able to prevent excessive heater temperature in the event of a failure of a current supply switch used to switch the supply of current on and off. It would be desirable for the mechanism used to prevent excessive heater temperature to be small and to consume minimal power.

SUMMARY

In a first aspect, there is provided a method of controlling an electric heater in an electrically heated smoking system comprising: providing electrical power to the heater in pulses such that during an active periods power is supplied to the heater and during inactive periods power is not supplied to the heater; charging a capacitor in an RC circuit during inactive periods and allowing the capacitor to discharge during active periods; and monitoring a discharge voltage of the capacitor and if the discharge voltage of the capacitor drops below a threshold voltage level, then stopping further supply of electrical power to the heater.

This method allows for consistent and reliable detection of a switch failure using compact and low power components.

BRIEF DESCRIPTION OF THE DRAWINGS

Embodiments will now be further described, by way of example only, with reference to the accompanying drawings in which.

DETAILED DESCRIPTION

Figure 1:
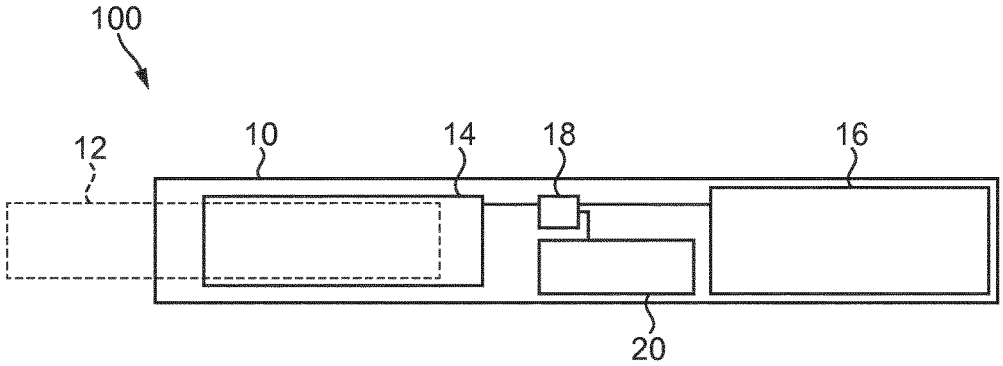
FIG. 1 is a schematic illustration of an electrically heated smoking system according to an embodiment.

According to the first aspect, the power may be provided to the heater by regularly switching a first switch and the step of stopping further supply of electrical power to the heater may comprise switching a second switch.

The time constant of the RC circuit may be greater than twice the duration of the pulses of electrical power provided to the heater. This ensures that normal operation of the switch cannot lead to stopping of further electrical power to the heater.

In a second aspect, there is provided an electrically heated smoking system comprising:

a power supply;

an electric heater;

a first switch connected between the electric heater and electrical ground;

a second switch connected between the power supply and the electric heater;

an RC circuit comprising a capacitor and connected to the power supply such the capacitor charges up when the first switch is open and discharges when the first switch is closed; and control circuitry connected to the RC circuit and configured to monitor a discharge voltage of the RC circuit and to open the second switch when the discharge voltage of the RC circuit falls below a threshold value.

The first switch may be operated by the control circuitry to provide power to the heating element as pulses of electric current. The power provided to the heating element may then be adjusted by adjusting the duty cycle of the electric current. The duty cycle may be adjusted by altering the pulse width, or the frequency of the pulses or both.

The RC circuit and control circuitry can be implemented in a small package that consumes very little power. The control circuitry may comprise a Schmitt trigger connected between the RC circuit and second switch, the Schmitt trigger being configured to open the open the second switch when the discharge voltage of the RC circuit falls below a threshold value.

The system may further comprise a diode configured to prevent discharge of the RC circuit through the first switch when the first switch is closed. "Open" in this context mean allowing current to flow. The term "on" in relation to the first and second switches is also used mean allowing current to flow. "Closed" in this context means not allowing current to flow and the term "off" is also used to mean the same thing.

The RC circuit may have a time constant greater than twice the longest period for which the first switch is closed during normal operation of the system.

The system may further comprise a controller configured to control the operation of the first switch to maintain the electric heater at a target temperature.

The system may further comprise an inverter connected between the RC circuit and the second switch. The use of an inverter allows for safe operation of the system even in case of a failure of the controller.

In both the first and second aspects of the invention the first switch may be a MOSFET, and is advantageously an n-channel MOSFET.

In both the first and second aspects of the invention, the second switch may be a MOSFET, and is advantageously a p-channel MOSFET.

In both the first and second aspects of the invention, the system may further comprise a power supply for supplying power to the heating element. The power supply may be any suitable power supply, for example a DC voltage source such as a battery. In one embodiment, the power supply is a Lithium-ion battery. Alternatively, the power supply may be a Nickel-metal hydride battery, a Nickel cadmium battery, or a Lithium based battery, for example a Lithium-Cobalt, a Lithium-Iron-Phosphate, Lithium Titanate or a Lithium-Polymer battery.

In both the first and second aspects of the invention, the electric heater may comprise a heating element which may comprise an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum platinum, gold and silver. Examples of suitable metal alloys include stainless steel, nickel-, cobalt-, chromium-, aluminium-, titanium-, zirconium-, hafnium-, niobium-, molybdenum-, tantalum-, tungsten-, tin-, gallium-, manganese-, gold- and iron-containing alloys, and super-alloys based on nickel, iron, cobalt, stainless steel, Timetal® and iron-manganese-aluminium based alloys. In composite materials, the electrically resistive material may optionally be embedded in, encapsulated or coated with an insulating material or vice-versa, depending on the kinetics of energy transfer and the external physicochemical properties required.

In both the first and second aspects of the invention, the system may comprise an electrically heated aerosol-generating device. As used herein, an 'aerosol-generating device' relates to a device that interacts with an aerosol-forming substrate to generate an aerosol. The aerosol-forming substrate may be part of an aerosol-generating article, for example part of a smoking article. An aerosol-generating device may be a smoking device that interacts with an aerosol-forming substrate of an aerosol-generating article to generate an aerosol that is directly inhalable into a user's lungs thorough the user's mouth. An aerosol-generating device may be a holder.

As used herein, the term 'aerosol-forming substrate' relates to a substrate capable of releasing volatile compounds that can form an aerosol. Such volatile compounds may be released by heating the aerosol-forming substrate. An aerosol-forming substrate may conveniently be part of an aerosol-generating article or smoking article.

As used herein, the terms 'aerosol-generating article' and 'smoking article' refer to an article comprising an aerosol-forming substrate that is capable of releasing volatile compounds that can form an aerosol. For example, an aerosol-generating article may be a smoking article that generates an aerosol that is directly inhalable into a user's lungs through the users mouth. An aerosol-generating article may be disposable. The term 'smoking article' is generally used hereafter. A smoking article may be, or may comprise, a tobacco stick.

In both the first and second aspects of the invention, the aerosol-generating device may comprise an internal heating element or an external heating element, or both internal and external heating elements, where "internal" and "external" refer to the aerosol-forming substrate. An internal heating element may take any suitable form. For example, an internal heating element may take the form of a heating blade. Alternatively, the internal heater may take the form of a casing or substrate having different electro-conductive portions, or an electrically resistive metallic tube. Alternatively, the internal heating element may be one or more heating needles or rods that run through the centre of the aerosol-forming substrate. Other alternatives include a heating wire or filament, for example a Ni—Cr (Nickel-Chromium), platinum, tungsten or alloy wire or a heating plate. Optionally, the internal heating element may be deposited in or on a rigid carrier material. In one such embodiment, the electrically resistive heating element may be formed using a metal having a defined relationship between temperature and resistivity. In such an exemplary device, the metal may be formed as a track on a suitable insulating material, such as ceramic material, and then sandwiched in another insulating material, such as a glass. Heaters formed in this manner may be used to both heat and monitor the temperature of the heating elements during operation.

An external heating element may take any suitable form. For example, an external heating element may take the form of one or more flexible heating foils on a dielectric substrate, such as polyimide. The flexible heating foils can be shaped to conform to the perimeter of the substrate receiving cavity. Alternatively, an external heating element may take the form of a metallic grid or grids, a flexible printed circuit board, a moulded interconnect device (MID), ceramic heater, flexible carbon fibre heater or may be formed using a coating technique, such as plasma vapour deposition, on a suitable shaped substrate. An external heating element may also be formed using a metal having a defined relationship between temperature and resistivity. In such an exemplary device, the metal may be formed as a track between two layers of suitable insulating materials. An external heating element formed in this manner may be used to both heat and monitor the temperature of the external heating element during operation.

The internal or external heating element may comprise a heat sink, or heat reservoir comprising a material capable of absorbing and storing heat and subsequently releasing the heat over time to the aerosol-forming substrate. The heat sink may be formed of any suitable material, such as a suitable metal or ceramic material. In one embodiment, the material has a high heat capacity (sensible heat storage material), or is a material capable of absorbing and subsequently releasing heat via a reversible process, such as a high temperature phase change. Suitable sensible heat storage materials include silica gel, alumina, carbon, glass mat, glass fibre, minerals, a metal or alloy such as aluminium, silver or lead, and a cellulose material such as paper. Other suitable materials which release heat via a reversible phase change include paraffin, sodium acetate, naphthalene, wax, polyethylene oxide, a metal, metal salt, a mixture of eutectic salts or an alloy. The heat sink or heat reservoir may be arranged such that it is directly in contact with the aerosol-forming substrate and can transfer the stored heat directly to the substrate. Alternatively, the heat stored in the heat sink or heat reservoir may be transferred to the aerosol-forming substrate by means of a heat conductor, such as a metallic tube.

The heating element advantageously heats the aerosol-forming substrate by means of conduction. The heating element may be at least partially in contact with the substrate, or the carrier on which the substrate is deposited. Alternatively, the heat from either an internal or external heating element may be conducted to the substrate by means of a heat conductive element.

In both the first and second aspects of the invention, during operation, the aerosol-forming substrate may be completely contained within the aerosol-generating device. In that case, a user may puff on a mouthpiece of the aerosol-generating device. Alternatively, during operation a smoking article containing the aerosol-forming substrate may be partially contained within the aerosol-generating device. In that case, the user may puff directly on the smoking article. The heating element may be positioned within a cavity in the device, wherein the cavity is configured to receive an aerosol-forming substrate such that in use the heating element is within the aerosol-forming substrate.

The smoking article may be substantially cylindrical in shape. The smoking article may be substantially elongate. The smoking article may have a length and a circumference substantially perpendicular to the length. The aerosol-forming substrate may be substantially cylindrical in shape. The aerosol-forming substrate may be substantially elongate. The aerosol-forming substrate may also have a length and a circumference substantially perpendicular to the length.

The smoking article may have a total length between approximately 30 mm and approximately 100 mm. The smoking article may have an external diameter between approximately 5 mm and approximately 12 mm. The smoking article may comprise a filter plug. The filter plug may be located at the downstream end of the smoking article. The filter plug may be a cellulose acetate filter plug. The filter plug is approximately 7 mm in length in one embodiment, but may have a length of between approximately 5 mm to approximately 10 mm.

In one embodiment, the smoking article has a total length of approximately 45 mm. The smoking article may have an external diameter of approximately 7.2 mm. Further, the aerosol-forming substrate may have a length of approximately 10 mm. Alternatively, the aerosol-forming substrate may have a length of approximately 12 mm. Further, the diameter of the aerosol-forming substrate may be between approximately 5 mm and approximately 12 mm. The smoking article may comprise an outer paper wrapper. Further, the smoking article may comprise a separation between the aerosol-forming substrate and the filter plug. The separation may be approximately 18 mm, but may be in the range of approximately 5 mm to approximately 25 mm. The separation is preferably filled in the smoking article by a heat exchanger that cools the aerosol as it passes through the smoking article from the substrate to the filter plug. The heat exchanger may be, for example, a polymer based filter, for example a crimped PLA material.

In both the first and second aspects of the invention, the aerosol-forming substrate may be a solid aerosol-forming substrate. Alternatively, the aerosol-forming substrate may comprise both solid and liquid components. The aerosol-forming substrate may comprise a tobacco-containing material containing volatile tobacco flavour compounds which are released from the substrate upon heating. Alternatively, the aerosol-forming substrate may comprise a non-tobacco material. The aerosol-forming substrate may further comprise an aerosol former. Examples of suitable aerosol formers are glycerine and propylene glycol.

If the aerosol-forming substrate is a solid aerosol-forming substrate, the solid aerosol-forming substrate may comprise, for example, one or more of: powder, granules, pellets, shreds, spaghettis, strips or sheets containing one or more of: herb leaf, tobacco leaf, fragments of tobacco ribs, reconstituted tobacco, homogenised tobacco, extruded tobacco, cast leaf tobacco and expanded tobacco. The solid aerosol-forming substrate may be in loose form, or may be provided in a suitable container or cartridge. Optionally, the solid aerosol-forming substrate may contain additional tobacco or non-tobacco volatile flavour compounds, to be released upon heating of the substrate. The solid aerosol-forming substrate may also contain capsules that, for example, include the additional tobacco or non-tobacco volatile flavour compounds and such capsules may melt during heating of the solid aerosol-forming substrate.

As used herein, homogenised tobacco refers to material formed by agglomerating particulate tobacco. Homogenised tobacco may be in the form of a sheet. Homogenised tobacco material may have an aerosol-former content of greater than 5% on a dry weight basis. Homogenised tobacco material may alternatively have an aerosol former content of between 5% and 30% by weight on a dry weight basis. Sheets of homogenised tobacco material may be formed by agglomerating particulate tobacco obtained by grinding or otherwise comminuting one or both of tobacco leaf lamina and tobacco leaf stems. Alternatively, or in addition, sheets of homogenised tobacco material may comprise one or more of tobacco dust, tobacco fines and other particulate tobacco by-products formed during, for example, the treating, handling and shipping of tobacco. Sheets of homogenised tobacco material may comprise one or more intrinsic binders, that is tobacco endogenous binders, one or more extrinsic binders, that is tobacco exogenous binders, or a combination thereof to help agglomerate the particulate tobacco; alternatively, or in addition, sheets of homogenised tobacco material may comprise other additives including, but not limited to, tobacco and non-tobacco fibres, aerosol-formers, humectants, plasticisers, flavourants, fillers, aqueous and non-aqueous solvents and combinations thereof.

Optionally, the solid aerosol-forming substrate may be provided on or embedded in a thermally stable carrier. The carrier may take the form of powder, granules, pellets, shreds, spaghettis, strips or sheets. Alternatively, the carrier may be a tubular carrier having a thin layer of the solid substrate deposited on its inner surface, or on its outer surface, or on both its inner and outer surfaces. Such a tubular carrier may be formed of, for example, a paper, or paper like material, a non-woven carbon fibre mat, a low mass open mesh metallic screen, or a perforated metallic foil or any other thermally stable polymer matrix.

The solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavour delivery during use.

Although reference is made to solid aerosol-forming substrates above, it will be clear to one of ordinary skill in the art that other forms of aerosol-forming substrate may be used with other embodiments. For example, the aerosol-forming substrate may be a liquid aerosol-forming substrate.

If a liquid aerosol-forming substrate is provided, the aerosol-generating device preferably comprises means for retaining the liquid. For example, the liquid aerosol-forming substrate may be retained in a container. Alternatively or in addition, the liquid aerosol-forming substrate may be absorbed into a porous carrier material. The porous carrier material may be made from any suitable absorbent plug or body, for example, a foamed metal or plastics material, polypropylene, terylene, nylon fibres or ceramic. The liquid aerosol-forming substrate may be retained in the porous carrier material prior to use of the aerosol-generating device or alternatively, the liquid aerosol-forming substrate material may be released into the porous carrier material during, or immediately prior to use. For example, the liquid aerosol-forming substrate may be provided in a capsule. The shell of the capsule preferably melts upon heating and releases the liquid aerosol-forming substrate into the porous carrier material. The capsule may optionally contain a solid in combination with the liquid.

Alternatively, the carrier may be a non-woven fabric or fibre bundle into which tobacco components have been incorporated. The non-woven fabric or fibre bundle may comprise, for example, carbon fibres, natural cellulose fibres, or cellulose derivative fibres.

In both the first and second aspects of the invention the system may be a handheld electrically heated smoking system.

Although the disclosure has been described by reference to different aspects, it should be clear that features described in relation to one aspect of the disclosure may be applied to the other aspects of the disclosure.

In FIG. 1, the components of an embodiment of an electrically heated aerosol-generating device 100 are shown in a simplified manner. Particularly, the elements of the electrically heated aerosol-generating device 100 are not drawn to scale in FIG. 1. Elements that are not relevant for the understanding of this embodiment have been omitted to simplify FIG. 1.

The electrically heated aerosol-generating device 100 comprises a housing 10 and an aerosol-forming substrate 12, for example a cigarette. The aerosol-forming substrate 12 is pushed inside the housing 10 to come into thermal proximity with the heating element 14. The aerosol-forming substrate 12 will release a range of volatile compounds at different temperatures. By controlling the operation temperature of the electrically heated aerosol-generating device 100 to be below the release temperature of some of the volatile compounds, the release or formation of these smoke constituents can be avoided.

Within the housing 10 there is an electrical energy supply 16, for example a rechargeable lithium ion battery. A controller 18 is connected to the heating element 14, the electrical energy supply 16, and a user interface 20, for example a button or display. The controller 18 controls the power supplied to the heating element 14 in order to regulate its temperature. Typically the aerosol-forming substrate is heated to a temperature of between 250 and 450 degrees centigrade.

Figure 2:
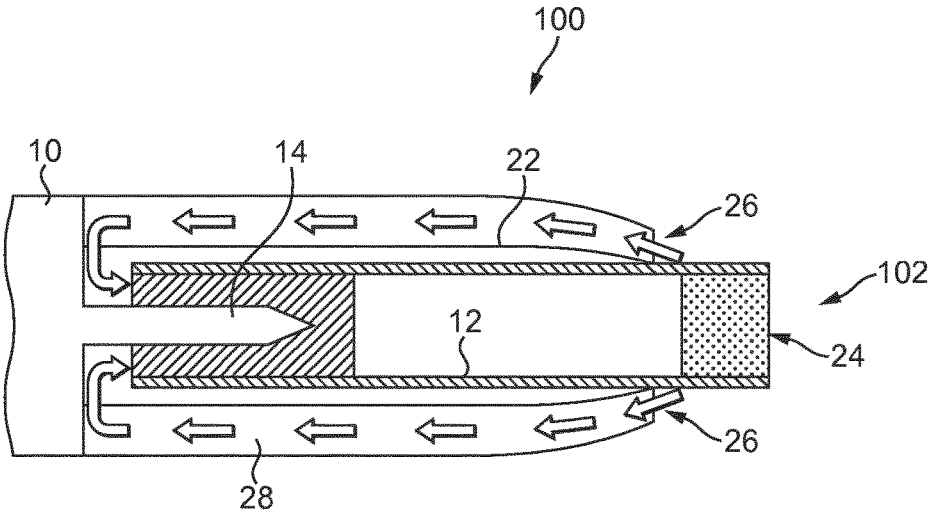
FIG. 2 is a schematic cross-section of the front end of a first embodiment of a device of the type shown in FIG. 1.

In the described embodiment the heating element 14 is an electrically resistive track or tracks deposited on a ceramic substrate. The ceramic substrate is in the form of a blade and is inserted into the aerosol-forming substrate 12 in use. FIG. 2 is a schematic representation of the front end of the device and illustrates the air flow through the device. It is noted that FIG. 2 does not accurately depict the relative scale of elements of the device. A smoking article 102, including an aerosol forming substrate 12 is received within the cavity 22 of the device 100. Air is drawn into the device by the action of a user sucking on a mouthpiece 24 of the smoking article 102. The air is drawn in through inlets 26 forming in a proximal face of the housing 10. The air drawn into the device passes through an air channel 28 around the outside of the cavity 22. The drawn air enters the aerosol-forming substrate 12 at the distal end of the smoking article 102 adjacent a proximal end of a blade shaped heating element 14 provided in the cavity 22. The drawn air proceeds through the aerosol-forming substrate 12, entraining the aerosol, and then to the mouth end of the smoking article 102. The aerosol-forming substrate 12 is a cylindrical plug of tobacco based material.

Figure 3:
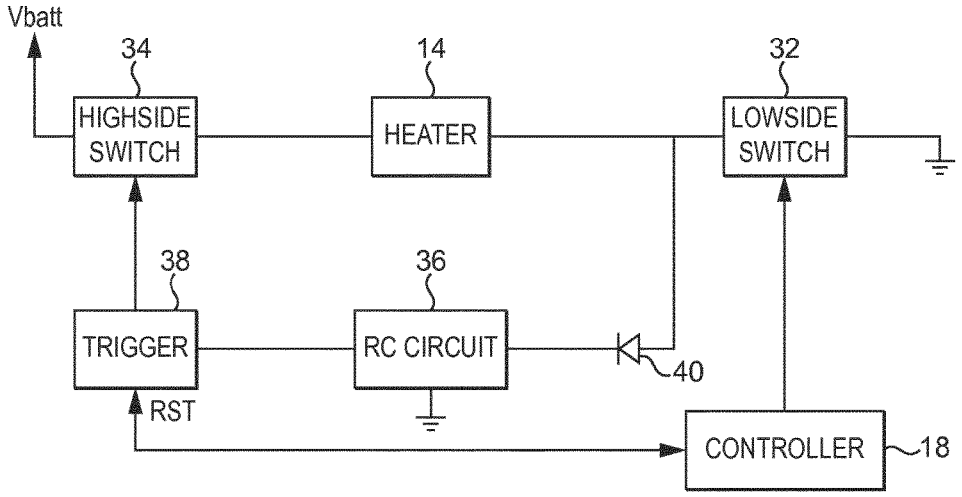
FIG. 3 is a schematic illustration of a switch failure monitoring circuit according to an embodiment.

FIG. 3 is a schematic illustration of a switch failure monitoring circuit in accordance with the invention. As shown in FIG. 3, the heater 14 is connected to electrical ground through a low side switch 32, also referred to as the first switch herein. The heater 14 is connected to the battery voltage through a high side switch 34, herein referred to as the second switch.

The first switch 32 is an n channel MOSFET. The second switch is a p channel MOSFET. During normal operation of the system, the second MOSFET 34 is maintained on, corresponding to the second switch being in a closed position, allowing current to flow from the battery to the heater. The first MOSFET 32 is switched on and off by the controller 18 in accordance with a particular duty cycle to control the temperature of the heater 14. When the first MOSFET 32 is on, corresponding to the switch being closed, current is allowed to flow from the heater to ground and the MOSFET 32 has a very low electrical resistance. Almost all of the battery voltage is then dropped across the heater and the heater heats up as a result of the Joule effect. When the first MOSFET is off it presents a very high electrical resistance. In this case very little voltage is dropped across the heater and there is almost no heating of the heater as a result of the Joule effect.

If there is a fault with the first switch and it stays on allowing current to flow through the heater continuously the temperature of the heater will rise in an uncontrolled manner. To detect a fault with the first switch a monitoring system is provided. The monitoring system comprises an RC circuit 36 connected to the heater through a diode 40, and a trigger component 38 connected between the RC circuit and a control input of the second switch 34.

When the first switch 32 is off and so has very high resistance, the RC circuit 36 is allowed to quickly charge up as a result of the battery voltage. When the first switch 32 is on, the voltage at the low side switch is very close to ground and the RC circuit discharges. The diode 40 prevents the RC circuit discharging through the heater. The trigger component 38 receives the discharge voltage of the RC circuit and is configured to switch second switch off when the discharge voltage falls below a predetermined threshold.

During normal operation the first switch is on for a consistent time period (the active phase), for example 1 millisecond, and is off (the inactive phase) for periods between. It is possible to charge the RC circuit quickly during the inactive phase and allow it to discharge only slowly during the active phase by making the discharge path have a greater resistance than the charging path. So even at a maximum duty cycle, in which the first switch may be on for 99% of the time and off for only 1% of the time in order to increase the heater temperature, it can be ensured that the trigger only operates the second switch if the active phase lasts significantly longer than the expected 1 millisecond.

If the discharge voltage of the RC circuit falls below the triggering threshold of the trigger component, the second switch is switched to an off state and so power to the heater is stopped. At the same time the trigger component is configured to provide a reset signal to the controller 18 so that the controller can then reset the first switch to an off state, allowing the RC circuit to recharge, which in turn switched the trigger component 38 off allowing the second switch 34 to be reset to an on state.

By using the predictable timing of the discharge of an RC circuit and selecting the resistance and capacitance values of the components carefully, this arrangement can be used to ensure that the second switch is always turned off before the heater is able to reach a dangerous or even undesirable temperature. The monitoring system can be implemented in a small package that consumes very little power.

Figure 4:
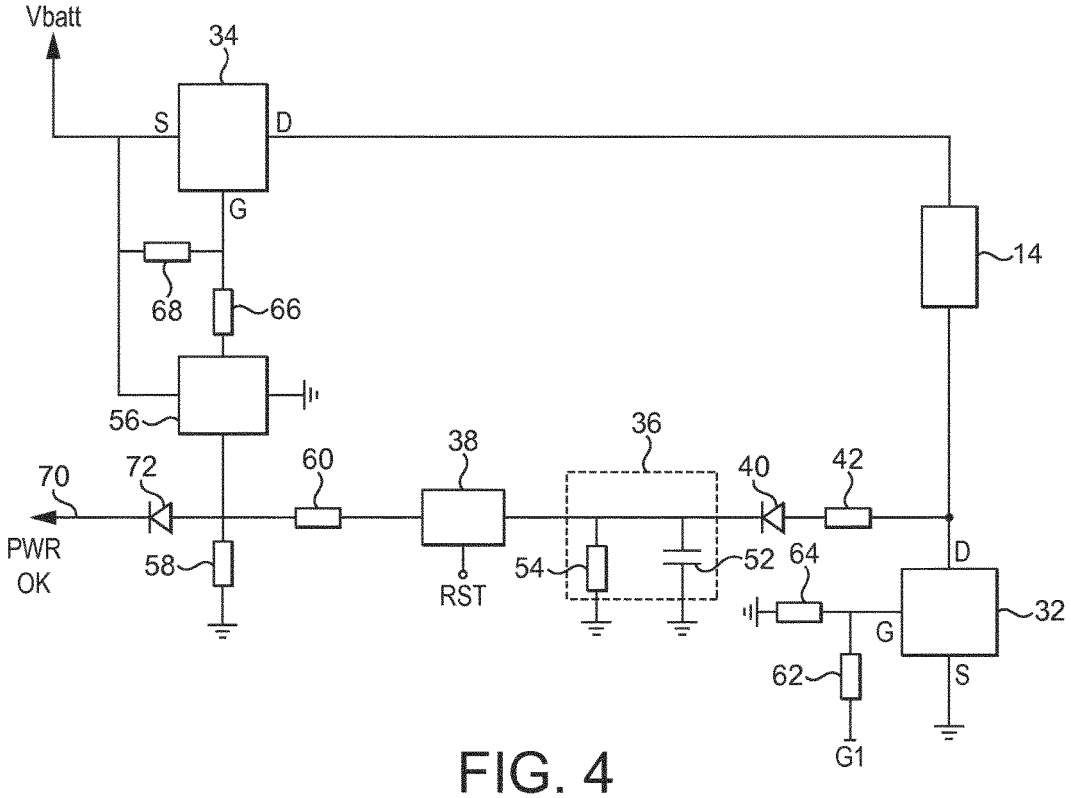
FIG. 4 is a schematic illustration of a circuit of the type shown in FIG. 2 and showing circuit components in greater detail.

FIG. 4 is an embodiment of a circuit of the type shown in FIG. 2 showing circuit components in greater detail. It can be seen in FIG. 4 that the first switch 32 is an n-channel MOSFET with the source connected to ground and the drain connected to the heater. The gate is connected to the controller through connection G1. A gate series resistor 62 is used to limit the current into the gate when the controller switches the gate. A pull-down resistor 64 is provided to hold the gate near the source voltage when the controller is resetting and the G1 input is not being driven.

Diode 40 is a Schottky diode that allows the RC circuit to charge during the inactive phase while not allowing it to discharge through the first switch in the active phase. A diode series resistor 42 is provided to limit the peak current through the diode 40 when charging the RC circuit, especially at start-up.

The RC circuit 36 comprises a timing network resistor 54 and a timing network capacitor 52, each connected to ground.

The trigger component 38 is a Schmitt trigger that has a negative going threshold for the input voltage from the RC network, below which it will provide a switching output to inverter 56. The inverter 56, powered by the battery voltage, is then used to pull the input to the gate of the second switch, which is a p-channel MOSFET, to the source voltage, blocking the second switch. In normal operation the inverter ensures the gate is provided with an inverted battery voltage ($-V_{batt}$) so the second switch is on.

The controller is connected to the "Pwr ok" line 70. This allows the controller to monitor the output of the Schmitt trigger 38 and also allows the controller to disable the second switch by pulling the input to the inverter low through diode 72. A resistor 60 is provided for this purpose. Resistor 58 is a pull-down resistor ensuring that the input to the inverter 56 is low in case of a logic power supply failure.

Resistor 68 is a pull-up resistor ensuring that the gate of the second switch is pulled to the source voltage and keeps the switch blocked if the inverter 56 fails. Resistor 66 is a gate series resistor that limits the output current from the inverter 56.

It should be clear that, the exemplary embodiments described above illustrate but are not limiting. In view of the above discussed exemplary embodiments, other embodiments consistent with the above exemplary embodiments will now be apparent to one of ordinary skill in the art.

The invention claimed is:

1. A method of controlling an electric heater in an electrically heated smoking system, comprising:

providing electrical power to the heater in pulses such that during active periods power is supplied to the heater, and during inactive periods, power is not supplied to the heater;

charging a capacitor in an RC circuit during the inactive periods and allowing the capacitor to discharge during the active periods; and monitoring a discharge voltage of the capacitor and stopping further supply of electrical power to the heater if the discharge voltage drops below a threshold voltage level wherein the electrical power is provided to the heater by regularly switching a first switch, and wherein the stopping further supply of electrical power to the heater comprises switching a second switch.

2. The method according to claim 1, wherein a time constant of the RC circuit is greater than twice a time width of the pulses of the electrical power provided to the heater.

3. An electrically heated smoking system, comprising:

a power supply;

an electric heater;

a first switch connected between the electric heater and electrical ground;

a second switch connected between the power supply and the electric heater;

an RC circuit comprising a capacitor and being connected to the power supply, configured such that the capacitor charges from the power supply when the first switch is open and discharges when the first switch is closed; and control circuitry connected to the RC circuit and being configured to monitor a discharge voltage of the RC circuit and to open the second switch when the discharge voltage of the RC circuit falls below a threshold voltage value.

4. The electrically heated smoking system according to claim 3, wherein the control circuitry comprises a Schmitt trigger connected between the RC circuit and second switch, the Schmitt trigger being configured to open the second switch when the discharge voltage of the RC circuit falls below the threshold voltage value.

5. The electrically heated smoking system according to claim 3, wherein the first switch is a MOSFET.

6. The electrically heated smoking system according to claim 3, wherein the second switch is a MOSFET.

7. The electrically heated smoking system according to claim 3, further comprising a diode configured to prevent discharge of the RC circuit through the first switch when the first switch is closed.

8. The electrically heated smoking system according to claim 3, wherein the RC circuit has a time constant greater than twice a longest period for which the first switch is closed during normal operation of the system.

9. The electrically heated smoking system according to claim 3, further comprising an inverter connected between the RC circuit and the second switch.

10. The electrically heated smoking system according to claim 3, further comprising a controller configured to control operation of the first switch to maintain the electric heater at a target temperature.

11. The electrically heated smoking system according to claim 3, wherein the power supply is a battery.

12. The electrically heated smoking system according to claim 3, wherein the system is a handheld electrically heated smoking system.

13. The electrically heated smoking system according to claim 3, wherein the system is a heated tobacco smoking system.

* * * * *